US011753904B2

(12) United States Patent
Broussard

(10) Patent No.: US 11,753,904 B2
(45) Date of Patent: Sep. 12, 2023

(54) VALVE HAVING A MODULAR ACTIVATION SYSTEM

(71) Applicant: Taylor Broussard, Houston, TX (US)

(72) Inventor: Taylor Broussard, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 26 days.

(21) Appl. No.: 17/315,448

(22) Filed: May 10, 2021

(65) Prior Publication Data

US 2022/0356784 A1 Nov. 10, 2022

(51) Int. Cl.
*E21B 34/10* (2006.01)
*E21B 23/04* (2006.01)

(52) U.S. Cl.
CPC ..... *E21B 34/108* (2013.01); *E21B 23/0413* (2020.05)

(58) Field of Classification Search
CPC .. E21B 23/0413; E21B 34/085; E21B 34/108; E21B 34/125; E21B 34/10; E21B 34/06; E21B 34/106; E21B 34/107; E21B 34/14
See application file for complete search history.

(56) References Cited

U.S. PATENT DOCUMENTS 4,415,038 A 11/1983 Schmuck
6,227,302 B1 * 5/2001 Pringle ..... E21B 43/123 166/387
6,276,458 B1 * 8/2001 Malone ..... E21B 21/10 166/240
6,321,842 B1 * 11/2001 Pringle ..... E21B 43/32 166/194
9,121,247 B2 9/2015 George et al.
10,767,446 B2 9/2020 Shimmoto et al.
2015/0369007 A1 12/2015 George et al.
2017/0342804 A1 11/2017 Poluchalla et al.
2017/0370168 A1 * 12/2017 Farrar ..... E21B 23/04
2020/0157917 A1 * 5/2020 Olguin ..... E21B 34/14
2020/0256158 A1 8/2020 Bacsik et al.

FOREIGN PATENT DOCUMENTS

JP 2017025553 A 2/2017
KR 101492238 B1 2/2015

OTHER PUBLICATIONS

International Search Report and Written Opinion dated Sep. 15, 2022 in PCT/US2022/028265; 9 pages.

* cited by examiner

*Primary Examiner* — Nicole Coy
*Assistant Examiner* — Nicholas D Wlodarski
(74) *Attorney, Agent, or Firm* — CANTOR COLBURN LLP

(57) ABSTRACT

A valve includes a body having a wall including an outer surface, an inner surface defining a passage, an opening extending from the passage through the outer surface. The outer surface includes a recess. A valve sleeve is arranged in the passage and is selectively positioned over the opening. A valve actuator module is detachably mounted in the recess. The valve actuator module includes a housing having an inlet fluidically exposed to the passage, an outlet fluidically exposed to the valve sleeve, and a valve member arranged between the inlet and the outlet. The valve member includes an actuator delay mechanism.

19 Claims, 4 Drawing Sheets

VALVE HAVING A MODULAR ACTIVATION SYSTEM

BACKGROUND

In the resource recovery industry valves are ubiquitous. Valves control fluid flow from a tubular into a formation and from the formation into the tubular. Valves also control fluid pressure acting on various downhole tools. Often times, the valves employ sleeves that are shifted to expose and/or cover ports. The sleeves may be shifted hydraulically, electrically, and/or mechanically. A toe sleeve is a valve that selectively opens at a toe of a well bore to allow fluid communication to an annulus. Often times, the toe sleeve is opened to perform a pressure check prior to fracturing operations.

A toe sleeve relies on an entire cross-section to house components that promote pressure cycling and timed delay mechanisms. The pressure cycling and time delay mechanisms includes large springs, snap rings, and other precision made components that detract from an overall flow area of the toe sleeve. Local conditional may necessitate a need to adjust/replace springs and other components. The limited flow and the time and expertise needed to manufacture the precision components as well as the need to adjust internal parts to meet local conditions add to an overall manufacturing and usage cost of the toe sleeve.

SUMMARY

Disclosed is a valve including a body having a wall including an outer surface, an inner surface defining a passage, an opening extending from the passage through the outer surface. The outer surface includes a recess. A valve sleeve is arranged in the passage and is selectively positioned over the opening. A valve actuator module is detachably mounted in the recess. The valve actuator module includes a housing having an inlet fluidically exposed to the passage, an outlet fluidically exposed to the valve sleeve, and a valve member arranged between the inlet and the outlet. The valve member includes an actuator delay mechanism.

Also disclosed is a resource exploration and recovery system including a surface system, and a subsurface system including a well bore extending into a formation. The well bore has a toe. A tubular string extends from the surface system into the well bore toward the toe. The tubular string supports a valve including a body including a wall having an outer surface, an inner surface defining a passage, and an opening extending from the passage through the outer surface. The outer surface includes a recess. A valve sleeve is arranged in the passage and is selectively positioned over the opening. A valve actuator module is detachably mounted in the recess. The valve actuator module includes a housing having an inlet fluidically exposed to the passage, an outlet fluidically exposed to the valve sleeve, and a valve member arranged between the inlet and the outlet. The valve member includes an actuator delay mechanism.

Further disclosed is a method of selectively shifting a valve sleeve including detachably mounting a valve actuator module to a tubular, applying a fluid force through the tubular into an inlet of the valve actuator, shifting a valve member arranged in a valve chamber of the valve actuator allowing the fluid to pass from the inlet to an outlet of the valve module, applying the fluid pressure from the outlet to a sleeve in the tubular, and shifting the sleeve with the fluid pressure.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
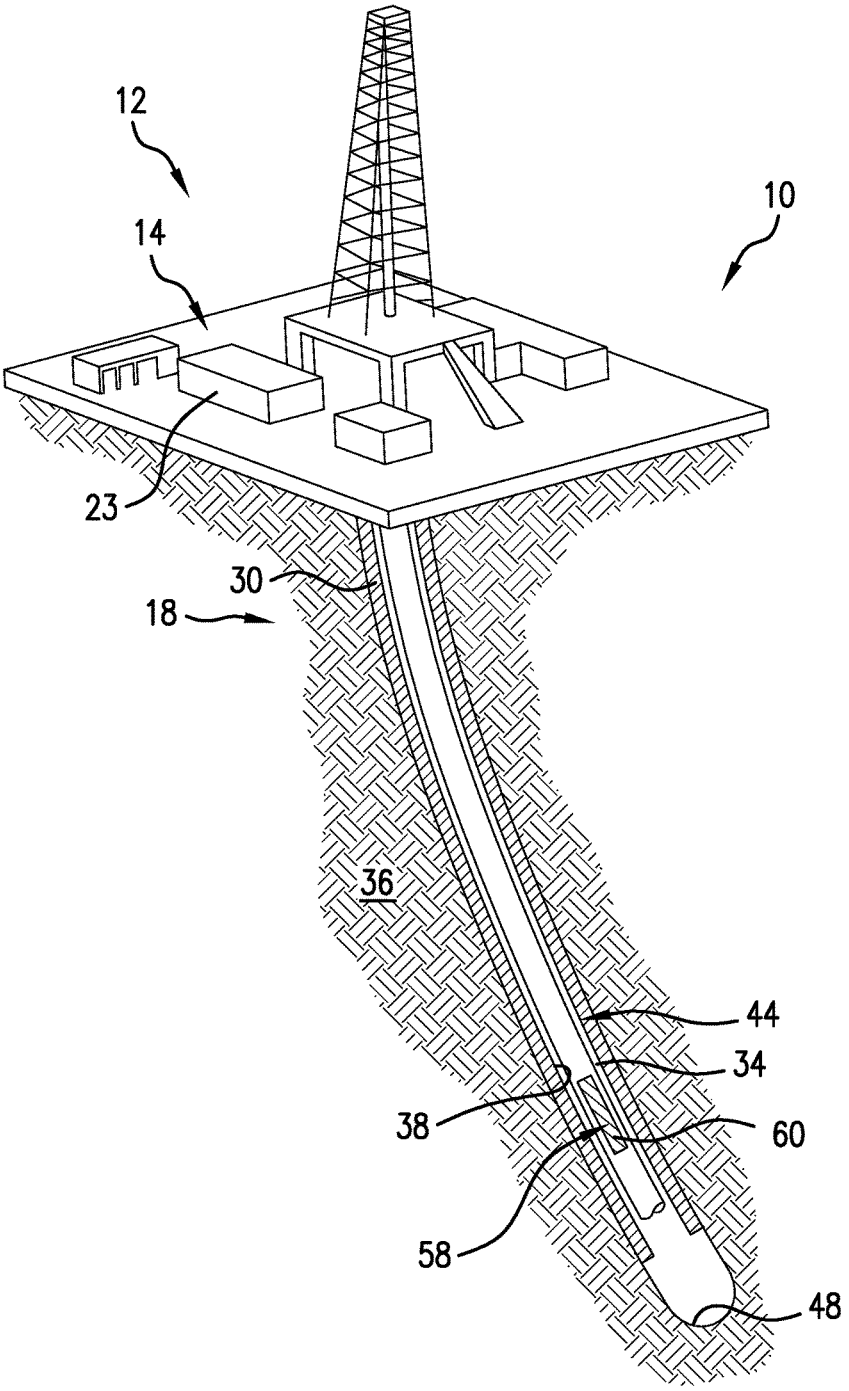
FIG. 1 depicts a resource exploration and recovery system including a valve having a modular actuation system, in accordance with a non-limiting example.

A resource exploration and recovery system, in accordance with an exemplary embodiment, is indicated generally at 10, in FIG. 1. Resource exploration and recovery system 10 should be understood to support well drilling operations, completions, resource extraction and recovery, $CO_2$ sequestration, and/or the like. Resource exploration and recovery system 10 may include a first system 12 which, in some environments, may take the form of a surface system 14 operatively and fluidically connected to a second system 18 which, in some environments, may take the form of a subsurface or downhole system (not separately labeled).

Surface system 14 may include a control system 23 that may provide power to, monitor, communicate with, and/or activate one or more downhole operations as will be discussed herein. Surface system 16 may also include additional systems such as pumps, fluid storage systems, cranes, and the like (not shown). Second system 18 may include a casing tubular 30 that extends into a wellbore 34 formed in a formation 36. Casing tubular 30 defines an inner surface 38 of wellbore 34. A tubular string 44, that may be formed from one or more tubulars, extends from surface system 14 toward a toe 48 of wellbore 34.

Figure 2:
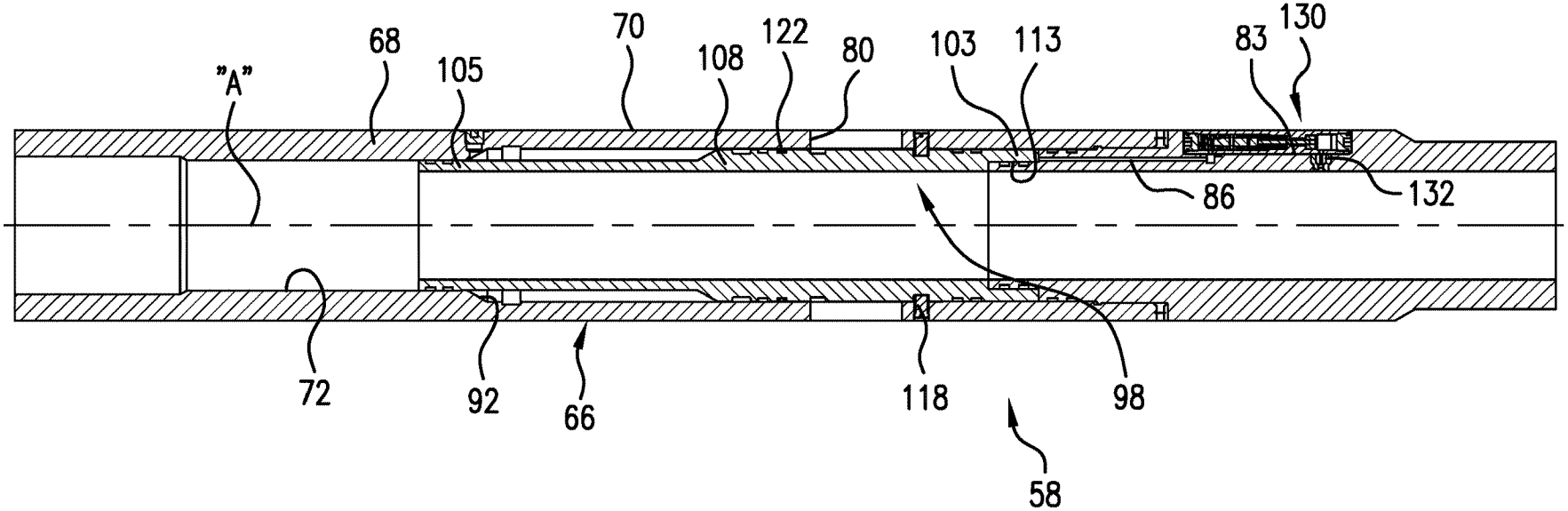
FIG. 2 depicts a cross-section side view of the valve of FIG. 1.

In a non-limiting example, tubular string 44 supports a valve 58 that may take the form of a toe sleeve 60. However, as will become more fully evident herein, valve 58 may be employed in a variety of locations and configurations. For example, valve 58 may be arranged within casing tubular 30 or in an open hole portion (not separately labeled) of wellbore 34. Referring to FIG. 2, valve 58 includes a tubular 66 having a body 68 that extends along a longitudinal axis "A". Body 68 includes an outer surface 70 and an inner surface 72 that defines a passage 74. An opening 80 extends through body 68 and selectively fluidically connects passage 74 with an area defined outwardly of outer surface 70 such as an annulus (not separately labeled) of wellbore 34.

Body 68 also includes a recess 83 formed in outer surface 70 and an activation passage 86 that extends from recess 83 through body 68 along axis "A". Activation passage 86 includes a first end portion (not separately labeled) and a second end portion (also not separately labeled). Inner surface 72 includes a shoulder 92 that is defined by a reduced diameter portion (also not separately labeled) of passage 74. A valve sleeve 98 is arranged in passage 74. Valve sleeve 98 is selectively shiftable along inner surface 72 as will be detailed herein.

Valve sleeve 98 includes a first end portion 103, a second end portion 105, and an intermediate portion (not separately labeled) having a shoulder portion 108. Shoulder portion 108 selectively engages with shoulder 92 when valve sleeve 98 shifts to expose opening 80. Valve sleeve 98 includes an annular recess 113 at first end portion 103. Annular recess 113 forms a skirt (not separately labeled) that is received in a recess portion (also not separately labeled) formed in body 68. Activation passage 86 terminates at the recess portion to deliver an activation fluid to first end 103 of valve sleeve 98. Valve sleeve 98 is detachably fixed in passage 74 by a plurality of frangible dogs, one of which is indicated at 118. A plurality of seals, one of which is indicated at 122 is arranged about valve sleeve 98 and seal against inner surface 72.

In accordance with a non-limiting example, a valve actuator module 130 that delivers an actuation force to valve sleeve 98. In the non-limiting example shown and described herein, valve actuator module 130 operates on fluid, but it should be appreciated that other operation principles may also be applied. Valve actuator module 130 is arranged in recess 83 over an inlet passage 132. In the non-limiting example shown, inlet passage 132 may include a frangible disc 135 that establishes a pressure barrier between passage 74 and valve actuator module 130 until a predetermined pressure threshold is met.

Figure 3:
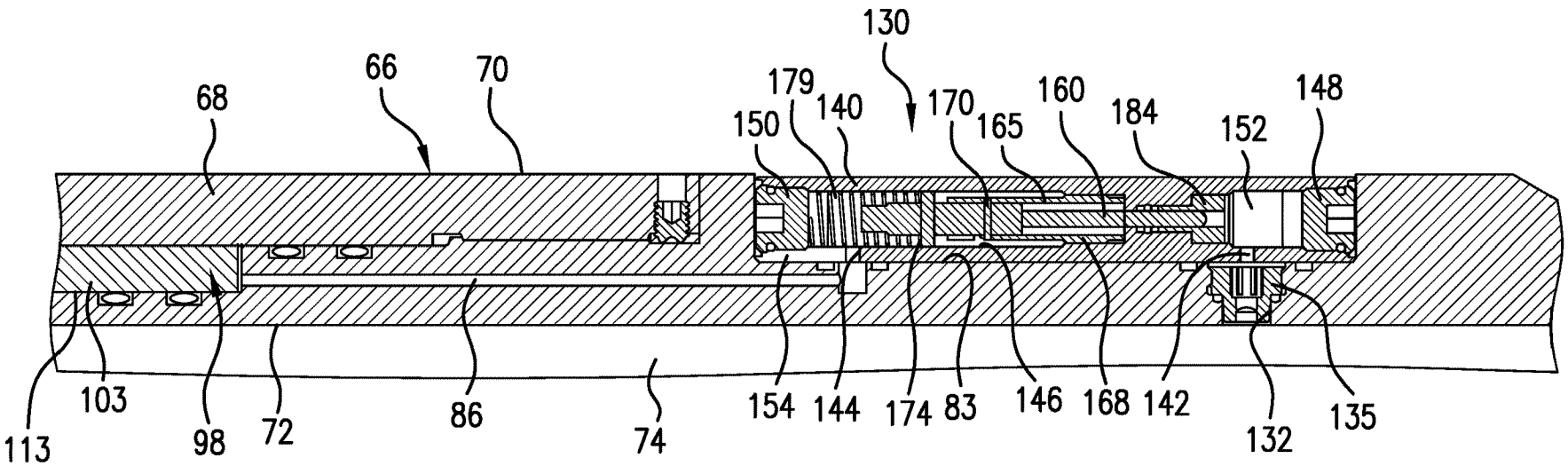
FIG. 3 is a partial cross-sectional side view of the valve of FIG. 2.
Figure 4:
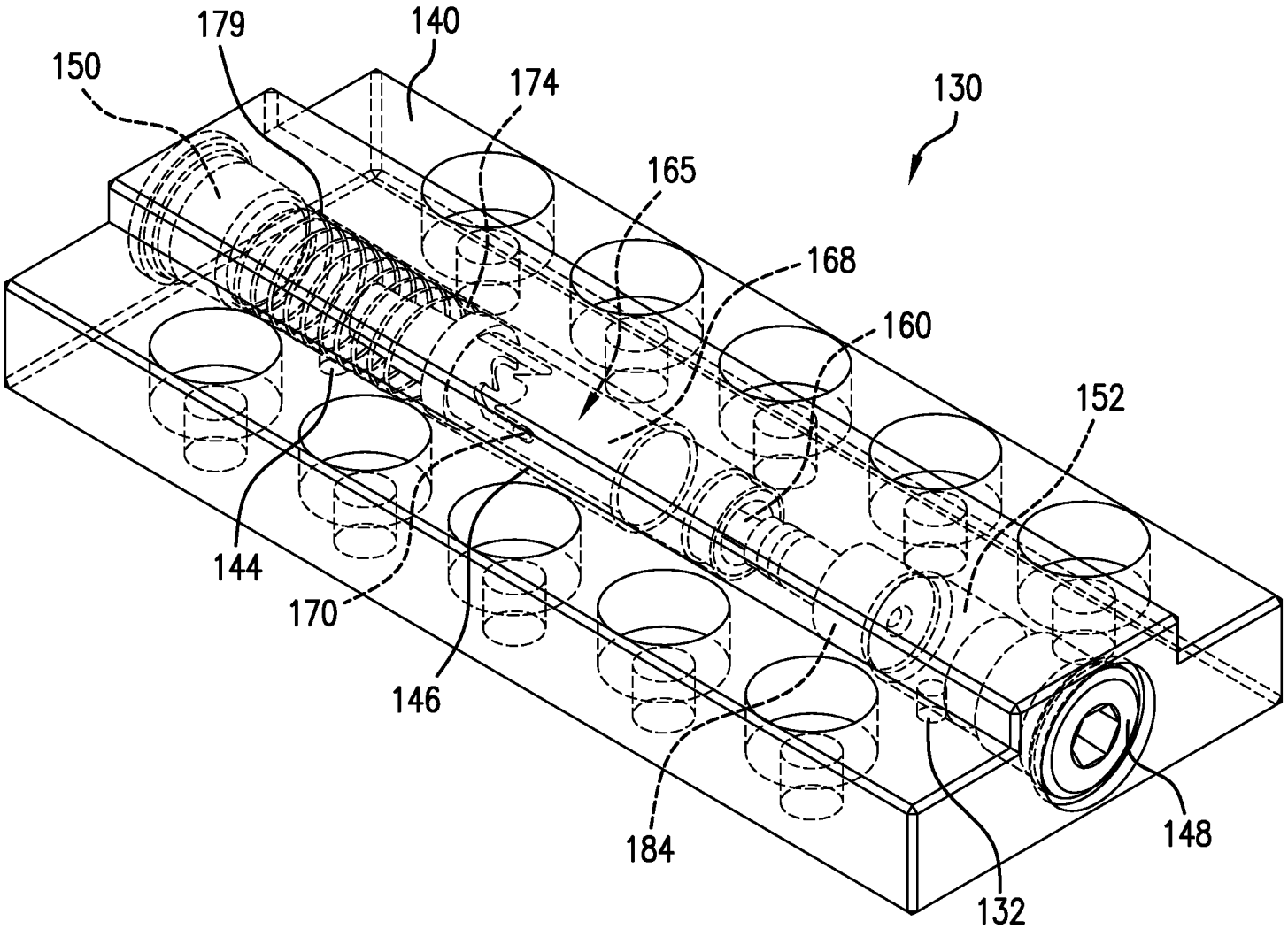
FIG. 4 depicts a glass view of the modular actuation system, in accordance with a non-limiting example

In a non-limiting example depicted in FIGS. 3 and 4, valve actuator module 130 includes a housing 140 having an inlet 142 that registers with inlet passage 132 and an outlet 144 that registers with activation passage 86. A valve chamber 146 is disposed between inlet 142 and outlet 144. A first access member 148 is mounted to a first end (not separately labeled) of housing 140 and a second access member 150 is mounted to a second, opposing end (also not separately labeled) of housing 140. Valve chamber 146 includes a first end 152 that is accessible through first access member 148 and a second end 154 that is accessible through second access member 150.

In a non-limiting example, a valve member 160 is arranged in valve chamber 146. Valve member 160 is shiftable between first end 152 and second end 154 through an actuator delay mechanism 165. In a non-limiting example, actuator delay mechanism 165 takes the form of a J-track member 168 fixed in valve chamber 146. Valve member 160 supports a pin 170 that transition into and out of a number of slots (not separately labeled) formed in J-track member 168. The number of slots may vary and could depend on the number of activation pulses desired before exposing opening 80.

Valve member 160 includes a seal element 174 that engages with an inner surface of valve chamber 146. A spring 179 is disposed between seal element 174 and second access member 150. An orifice 184 is mounted at first end 152 of valve chamber 146. Orifice 184 may be installed through first access member 148. Orifice 184 supports an O-ring (not separately labeled) or, in the absence of the frangible disc, may be chosen to provide a selected application pressure on valve member 160. In a non-limiting example, fluid may be passed through passage 74. The fluid may travel through inlet passage 132 and into valve actuator module 130 via frangible disc 135.

The fluid enters into first end 152 of valve chamber 146 and acts on valve member 160. Valve member 160 travels toward second end 154 compressing spring 179. As valve member 160 travels in valve chamber 146, pin 170 transitions in J-track member 168. Pressure may then be alleviated thereby allowing spring 179 to bias valve member 160 back towards first end 152. Each application of pressure causes pin 170 to travel in J-track member 168.

After a select number of pressure applications, pin 170 passes through an open track allowing seal element 174 to fully transition to second end 154 thereby exposing outlet 144 to fluid pressure. At this point, fluid pressure may be increased or simply applied to valve sleeve 98 via activation passage 86. Valve sleeve 98 shifts within passage 74 until shoulder portion 108 abuts shoulder 92. At this point, opening 80 may be exposed to wellbore 34. Fluid may pass through opening 80 to perform a pressure check on wellbore 34 prior to initiating, for example, a fracking operation.

Set forth below are some embodiments of the foregoing disclosure:

Embodiment 1. A valve comprising: a body including a wall having an outer surface, an inner surface defining a passage, an opening extending from the passage through the outer surface, the outer surface including a recess; a valve sleeve arranged in the passage and selectively positioned over the opening; and a valve actuator module detachably mounted in the recess, the valve actuator module including a housing having an inlet fluidically exposed to the passage, an outlet fluidically exposed to the valve sleeve, and a valve member arranged between the inlet and the outlet, the valve member including an actuator delay mechanism.

Embodiment 2. The valve according to any prior embodiment, wherein the body includes an inlet portion, an outlet portion, and an activation passage extending therebetween, the inlet portion being exposed to the inlet and the outlet portion being exposed to the valve actuator.

Embodiment 3. The valve according to any prior embodiment, wherein the actuator delay mechanism includes a J-track member operable to shift the valve member past the outlet following a predetermined number of pressure cycles.

Embodiment 4. The valve according to any prior embodiment, wherein the housing includes a valve chamber having a first end exposed to the inlet, a second end, the outlet being spaced from the second end.

Embodiment 5. The valve according to any prior embodiment, wherein the valve member includes a seal element that engages internal surfaces of the valve chamber.

Embodiment 6. The valve according to any prior embodiment, further comprising: a spring arranged between the second end and the seal element.

Embodiment 7. The valve according to any prior embodiment, further comprising: a first access member mounted to the housing at the first end of the valve chamber and a second access member mounted to the housing at the second end of the valve chamber, each of the first access member and the second access member providing access to the valve chamber.

Embodiment 8. The valve according to any prior embodiment, further comprising: a selectively removable orifice member arranged between the inlet and the valve member, the selectively removable orifice creating a pressure barrier between the inlet and the valve chamber.

Embodiment 9. The valve according to any prior embodiment, wherein the valve defines a toe sleeve.

Embodiment 10. A resource exploration and recovery system comprising: a surface system; a subsurface system including a well bore extending into a formation, the well bore having a toe; a tubular string extending from the surface system into the well bore toward the toe, the tubular string supporting a valve comprising: a body including a wall having an outer surface, an inner surface defining a passage, an opening extending from the passage through the outer surface the outer surface including a recess; a valve sleeve arranged in the passage and selectively positioned over the opening; and a valve actuator module detachably mounted in the recess, the valve actuator module including a housing having an inlet fluidically exposed to the passage, an outlet fluidically exposed to the valve sleeve, and a valve member arranged between the inlet and the outlet, the valve member including an actuator delay mechanism.

Embodiment 11. The resource exploration and recovery system according to any prior embodiment, wherein the body includes an inlet portion, an outlet portion, and an activation passage extending therebetween, the inlet portion being exposed to the inlet and the outlet portion being exposed to the valve actuator.

Embodiment 12. The resource exploration and recovery system according to any prior embodiment, wherein the actuator delay mechanism includes a J-track member operable to shift the valve member past the valve outlet following a predetermined number of pressure cycles.

Embodiment 13. The resource exploration and recovery system according to any prior embodiment, wherein the housing includes a valve chamber having a first end exposed to the inlet, a second end, the outlet being spaced from the second end.

Embodiment 14. The resource exploration and recovery system according to any prior embodiment, wherein the valve member includes a seal element that engages internal surfaces of the valve chamber.

Embodiment 15. The resource exploration and recovery system according to any prior embodiment, further comprising: a spring arranged between the second end and the seal element.

Embodiment 16. The resource exploration and recovery system according to any prior embodiment, further comprising: a first access member mounted to the body at the first end of the valve chamber and a second access member mounted to the body at the second end of the valve chamber, each of the first and second access members providing access to the valve chamber.

Embodiment 17. The resource exploration and recovery system according to any prior embodiment, further comprising: a selectively removable orifice member arranged between the inlet and the valve member, the selectively removable orifice creating a pressure barrier between the inlet and the valve chamber.

Embodiment 18. The resource exploration and recovery system according to any prior embodiment, wherein the valve defines a toe sleeve.

Embodiment 19. A method of selectively shifting a valve sleeve comprising: detachably mounting a valve actuator module to a tubular; applying a fluid force through the tubular into an inlet of the valve actuator; shifting a valve member arranged in a valve chamber of the valve actuator allowing the fluid to pass from the inlet to an outlet of the valve module; applying the fluid pressure from the outlet to a sleeve in the tubular; and shifting the sleeve with the fluid pressure.

Embodiment 20. The method according to any prior embodiment, wherein detachably mounting the valve actuator includes bolting an actuator housing to an outer surface of the tubular.

Embodiment 21. The method according to any prior embodiment, wherein applying fluid pressure to the inlet includes directing fluid pressure onto a valve member arranged in a valve chamber.

Embodiment 22. The method according to any prior embodiment, wherein directing fluid pressure onto the valve member compresses a spring in the valve chamber.

Embodiment 23. The method according to any prior embodiment, wherein shifting the valve member includes applying pressure cycles to the valve actuator.

Embodiment 24. The method according to any prior embodiment, wherein applying pressure cycles includes shifting a pin through a J-slot member arranged in the valve chamber.

Embodiment 25. The method according to any prior embodiment, further comprising: opening an access member exposing the valve chamber to install a selected spring into the valve actuator module to establish a selected operating pressure for the valve actuator module.

Embodiment 26. The method according to any prior embodiment, opening another access member exposing another end of the valve chamber to install an orifice member that may create a pressure barrier between the inlet and seal element.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A valve comprising:

a body including a wall having an outer surface, an inner surface defining a passage, an opening extending from the passage through the outer surface, the outer surface including a recess having a base wall a first end wall, and a second end wall, the recess being exposed at the outer surface;

an activation passage defined between the outer surface and the inner surface, the activation passage including a first end portion fluidically connected to the passage and a second end portion;

an annular valve sleeve arranged in the passage and selectively positioned over the opening, the annular valve sleeve including a central passage that is fluidly exposed to the second end portion of the activation passage;

a valve actuator module detachably mounted in the recess, the valve actuator module including a housing defining a portion of the outer surface of the body, the housing having an inlet fluidically exposed to the passage, an outlet fluidically exposed to the valve sleeve, a valve chamber having a first end exposed to the inlet, a second end, and an inner surface, the outlet being spaced from the second end, and a valve member arranged between the inlet and the outlet, the valve member including an actuator delay mechanism; and a first access member mounted to the housing at the first end of the valve chamber and a second access member mounted to the housing at the second end of the valve chamber, each of the first access member and the second access member providing access to the valve chamber.

2. The valve according to claim 1, wherein the actuator delay mechanism includes a J-track member operable to shift the valve member past the outlet following a predetermined number of pressure cycles.

3. The valve according to claim 1, wherein the valve member includes a seal element that engages the inner surface of the valve chamber.

4. The valve according to claim 3, further comprising: a spring arranged between the second end and the seal element.

5. The valve according to claim 1, further comprising: a selectively removable orifice member arranged between the inlet and the valve member, the selectively removable orifice creating a pressure barrier between the inlet and the valve chamber.

6. The valve according to claim 1, wherein the valve defines a toe sleeve.

7. A resource exploration and recovery system comprising:

a surface system;

a subsurface system including a well bore extending into a formation, the well bore having a toe;

a tubular string extending from the surface system into the well bore toward the toe, the tubular string supporting a valve comprising:

a body including a wall having an outer surface, an inner surface defining a passage, an opening extending from the passage through the outer surface, the outer surface including a recess having a base wall a first end wall, and a second end wall, the recess being exposed at the outer surface;

an activation passage defined between the outer surface and the inner surface, the activation passage including a first end portion fluidically connected to the passage and a second end portion;

an annular valve sleeve arranged in the passage and selectively positioned over the opening, the annular valve sleeve including a central passage that is fluidly exposed to the second end portion of the activation passage; and a valve actuator module detachably mounted in the recess, the valve actuator module including a housing defining a portion of the outer surface of the body, the housing having an inlet fluidically exposed to the passage, an outlet fluidically exposed to the valve sleeve, a valve chamber having a first end exposed to the inlet, a second end, and an inner surface, the outlet being spaced from the second end, and a valve member arranged between the inlet and the outlet, the valve member including an actuator delay mechanism; and a first access member mounted to the housing at the first end of the valve chamber and a second access member mounted to the housing at the second end of the valve chamber, each of the first access member and the second access member providing access to the valve chamber.

8. The resource exploration and recovery system according to claim 7, wherein the actuator delay mechanism includes a J-track member operable to shift the valve member past the valve outlet following a predetermined number of pressure cycles.

9. The resource exploration and recovery system according to claim 7, wherein the valve member includes a seal element that engages the inner surface of the valve chamber.

10. The resource exploration and recovery system according to claim 9, further comprising: a spring arranged between the second end and the seal element.

11. The resource exploration and recovery system according to claim 7, further comprising: a selectively removable orifice member arranged between the inlet and the valve member, the selectively removable orifice creating a pressure barrier between the inlet and the valve chamber.

12. The resource exploration and recovery system according to claim 7, wherein the valve defines a toe sleeve.

13. A method of selectively shifting an annular valve sleeve having a central passage, the method comprising:

detachably mounting a valve actuator module in a recess formed in an outer surface of a tubular, the recess being exposed at the outer surface;

opening an access member provided in the valve actuator module exposing the valve chamber to install a selected spring into the valve actuator module to establish a selected operating pressure for the valve actuator module;

applying a fluid force through the tubular into an inlet of the valve actuator module;

shifting a valve member arranged in a valve chamber of the valve actuator module allowing the fluid to pass from the inlet to an outlet of the valve actuator module;

directing the fluid from the outlet of the valve actuator module through an activation passage formed between the outer surface and an inner surface of the tubular;

applying the fluid pressure from the activation passage to the an annular valve sleeve arranged in the tubular; and shifting the annular valve sleeve with the fluid pressure.

14. The method of claim 13, wherein detachably mounting the valve actuator module includes bolting an actuator housing in the recess formed in the outer surface of the tubular.

15. The method of claim 13, wherein applying fluid pressure to the inlet includes directing fluid pressure onto a valve member arranged in a valve chamber.

16. The method of claim 15, wherein directing fluid pressure onto the valve member compresses a spring in the valve chamber.

17. The method of claim 13, wherein shifting the valve member includes applying pressure cycles to the valve actuator module.

18. The method of claim 17, wherein applying pressure cycles includes shifting a pin through a J-slot member arranged in the valve chamber.

19. The method of claim 13, opening another access member provided in the valve actuator module exposing another end of the valve chamber to install an orifice member that may create a pressure barrier between the inlet and seal element.

* * * * *